US008146670B2

(12) United States Patent
Ellis et al.

(10) Patent No.: US 8,146,670 B2
(45) Date of Patent: Apr. 3, 2012

(54) BI-DIRECTIONAL ANNULUS SEAL

(75) Inventors: Steven C. Ellis, The Woodlands, TX (US); Javier Garcia, Jr., Tomball, TX (US); Rick C. Hunter, Friendswood, TX (US); John E. Nelson, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 276 days.

(21) Appl. No.: 12/465,966

(22) Filed: May 14, 2009

(65) Prior Publication Data

US 2010/0126736 A1 May 27, 2010

Related U.S. Application Data

(60) Provisional application No. 61/117,879, filed on Nov. 25, 2008.

(51) Int. Cl.
*E21B 33/047* (2006.01)
*E21B 33/03* (2006.01)

(52) U.S. Cl. ..... 166/379; 166/75.13; 166/88.3; 166/368

(58) Field of Classification Search ..... 166/75.13, 166/88.3, 89.1, 89.3, 368, 379
See application file for complete search history.

(56) References Cited

U.S. PATENT DOCUMENTS 4,131,287 A 12/1978 Gunderson et al.
4,372,563 A 2/1983 Diehl et al.
4,665,979 A 5/1987 Boehm, Jr.
4,714,111 A 12/1987 Brammer
4,742,874 A 5/1988 Gullion
4,823,871 A 4/1989 McEver et al.
4,900,041 A 2/1990 Hopkins et al.
4,932,472 A 6/1990 Boehm, Jr.
5,060,724 A 10/1991 Brammer et al.
5,080,174 A 1/1992 Hynes
5,110,144 A * 5/1992 Burton et al. ..... 277/328
5,129,660 A 7/1992 Taylor et al.
5,174,376 A 12/1992 Singeetham
5,246,236 A 9/1993 Szarka et al.
5,285,853 A 2/1994 Eckert et al.
5,325,925 A * 7/1994 Smith et al. ..... 166/387
5,456,314 A 10/1995 Boehm, Jr. et al.
5,685,369 A 11/1997 Ellis et al.
5,725,056 A 3/1998 Thomson
6,367,558 B1 4/2002 Borak, Jr.
7,762,319 B2 * 7/2010 Nelson ..... 166/84.1
7,861,789 B2 * 1/2011 Nelson ..... 166/348
2006/0191680 A1 * 8/2006 Nelson ..... 166/208
2010/0116489 A1 * 5/2010 Nelson ..... 166/182
2010/0126736 A1 5/2010 Ellis et al.
2010/0147533 A1 * 6/2010 Nelson ..... 166/379

OTHER PUBLICATIONS

USPTO official office action—claims rejection, mailing date Feb. 6, 2009—U.S. Appl. No. 11/635,466, filed Dec. 7, 2006.

* cited by examiner

*Primary Examiner* — Jennifer H Gay
(74) *Attorney, Agent, or Firm* — Bracewell & Giuliani LLP

(57) ABSTRACT

A wellhead seal assembly forms a metal-to-metal seal between inner and outer wellhead members. A metal seal ring has inner and outer walls separated by a slot. A lock ring has grooves for locking the inner wellhead member to the outer wellhead member during installation. An energizing ring has a C-ring captured on its inner surface. When the energizing ring is moved further into the slot, the C-ring is forced from its pocket and engages the surface of the inner wellhead member, locking the seal assembly to the inner wellhead member.

16 Claims, 3 Drawing Sheets

BI-DIRECTIONAL ANNULUS SEAL

CROSS-REFERENCE TO RELATED APPLICATION

This application claims priority to provisional application 61/117,879, filed Nov. 25, 2008.

FIELD OF THE INVENTION

This technique relates in general to wellhead assemblies and in particular to a seal for sealing between inner and outer wellhead members.

BACKGROUND OF THE INVENTION

Seals are used between inner and outer wellhead tubular members to contain internal well pressure. The inner wellhead member may be a tubing hanger that supports a string of tubing extending into the well for the flow of production fluid. The tubing hanger lands in an outer wellhead member, which may be wellhead housing, a Christmas tree, or tubing head. A packoff or seal seals between the tubing hanger and the outer wellhead member. Alternately, the inner wellhead member might be a casing hanger located in a wellhead housing and secured to a string of casing extending into the well. A seal or packoff seals between the casing hanger and the wellhead housing.

A variety of seals of this nature have been employed in the prior art. Prior art seals include elastomeric and partially metal and elastomeric rings. Prior art seal rings made entirely of metal for forming metal-to-metal seals are also employed. The seals may be set by a running tool, or they may be set in response to the weight of the string of casing or tubing. One type of prior art metal-to-metal seal has inner and outer walls separated by a conical slot. An energizing ring is pushed into the slot to deform the inner and outer walls apart into sealing engagement with the inner and outer wellhead members. The energizing ring is a solid wedge-shaped member. The deformation of the inner and outer walls exceeds the yield strength of the material of the seal ring, making the deformation permanent Thermal growth between the casing or tubing and the wellhead may occur, particularly with wellheads located at the surface, rather than subsea. The well fluid flowing upward through the tubing heats the string of tubing, and to a lesser degree the surrounding casing. The temperature increase may cause the tubing hanger and/or casing hanger to move axially a slight amount relative to the outer wellhead member. During the heat up transient, the tubing hanger and/or casing hanger can also move radially due to temperature differences between components and the different rates of thermal expansion from which the component materials are constructed. If the seal has been set as a result of a wedging action where an axial displacement of energizing rings induces a radial movement of the seal against its mating surfaces, then sealing forces may be reduced if there is movement in the axial direction due to pressure or thermal effects. A reduction in axial force on the energizing ring results in a reduction in the radial inward and outward forces on the inner and outer walls of the seal ring, which may cause the seal to leak. A loss of radial loading between the seal and its mating surfaces due to thermal transients may also cause the seal to leak. The following technique may solve one or more of these problems.

SUMMARY OF THE INVENTION

The seal ring of this technique forms a metal-to-metal seal and has features that lock the seal to the high pressure housing and the hanger. The seal ring also has features that enable retrieval without risk of seal disassembly. The seal ring has inner and outer walls separated by a slot. A metal energizing ring is pushed into the slot during installation to deform the inner and outer walls into sealing engagement with inner and outer wellhead members.

In the embodiment shown, the seal ring is bi-directional, having upper and lower sections that are the same, each containing one of the slots. Preferably a lower energizing ring engages the slot of the lower section and then an upper energizing ring engages the slot of the upper section. Both the upper and lower outer leg of the seal ring are machined to form shoulders, which abut against shoulders located on the outer surface of the upper and lower energizing rings. The shoulders ensure that the seal assembly remains intact as one solid structure during landing, setting, and retrieval operations.

A lock ring is attached to the bottom of the lower energizing ring, and engages the wellhead housing when the seal ring lands, locking the well pipe hanger to the housing. A C-ring rests in a machined pocket on inner surface of the upper energizing ring, and engages the hanger when the seal is set, locking the seal to the hanger.

In the embodiment shown, a radial gap exists between the outer wall of the seal and the inner wall of the mating housing. Such gap is required for installation in the field and is sufficiently large to require plastic deformation of the seal body, but not the energizer rings. The soft metallic inserts may also prevent galling of the seal ring inner and outer members to their respective well pipe hanger and wellhead bore members. In order to accommodate sealing over scratches and surface trauma of the wellhead members, soft metallic inserts may be provided for on the seal. The size and thickness of the metallic inserts is sufficient to provide for scratch filling and therefore sealing between the mating members. The soft metallic inserts may also prevent galling of the seal ring inner and outer members to their respective casing/tubing hanger and wellhead bore members.

The combination of stored energy provided for by the energizing rings, the locking mechanisms of the seal ring and the energizing ring, and the compliant soft outer inserts, provides gas tight sealing under extreme thermal conditions. Alternatively, the soft inserts may be made from a non-metallic material or polymer such as PEEK (poly-ether-ether-ketone) or PPS (polyphenylene sulfide).

DETAILED DESCRIPTION OF THE INVENTION

Figure 1:
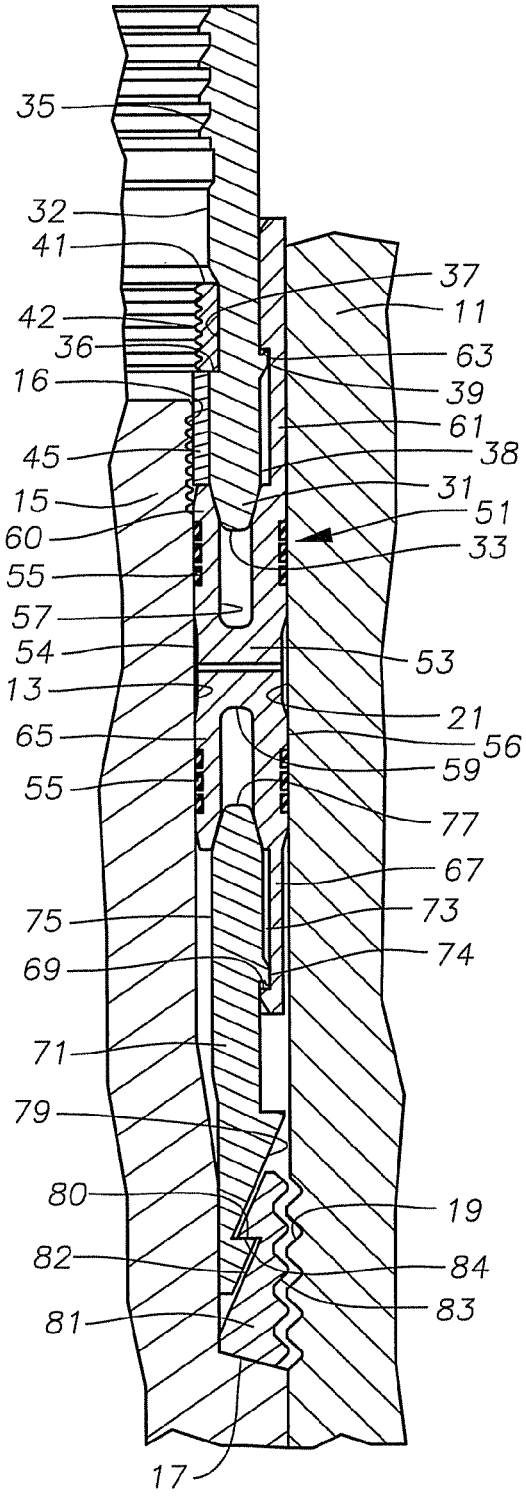
FIG. 1 is a sectional view of a seal assembly installed in accordance with an exemplary embodiment of the present technique, shown prior to energization.

Referring to FIG. 1, a portion of a high pressure wellhead housing 11 is shown. Housing 11 is located at an upper end of a well and serves as an outer wellhead member in this example. Housing 11 has a bore 21 located therein. In this embodiment, grooves 19 are positioned along a length of the inner surface of housing 11 in bore 21. Grooves 19 comprise parallel load flanks extending around the inner diameter of bore 21.

In this example, the inner wellhead member comprises a casing hanger 15, which is shown partially in FIG. 1 within bore 21. Alternately, wellhead housing 11 could be a tubing spool or a Christmas tree. Alternately, casing hanger 15 could be a tubing hanger, plug, safety valve or other device. Casing hanger 15 has an exterior annular recess radially spaced inward from bore 21 to define a seal pocket 13. In this embodiment, teeth 16 are positioned along a length of the outer surface of casing hanger 15, in seal pocket 13. Teeth 16 comprise parallel annular grooves extending around casing hanger 15. Casing hanger 15 has an upward facing shoulder 17 that defines the lower end of seal pocket 13.

A metal-to-metal seal assembly 51 is located in seal pocket 13. Seal assembly 51 includes a seal ring 53 formed of a metal such as steel. Seal ring 53 has an inner wall 54 comprised of upper seal leg 60 and lower seal leg 65 for sealing against the cylindrical wall of seal pocket 13. Seal ring 53 has an outer wall surface 56 comprised of upper seal leg 61 and lower seal leg 67 that seal against wellhead housing bore 21. In this example, inner wall 54 and outer wall 56 contain inserts 55 formed of a soft metal or alternatively made from a non-metallic material or polymer such as PEEK (poly-ether-ether-ketone) or PPS (polyphenylene sulfide). The inserts 55 are provided to lubricate between the housing bore 21 and the hanger pocket 13, and to form a seal between the casing hanger 15 and the seal assembly 51 on a first side of the seal assembly 51 and the seal assembly 51 and the wellhead 11 on a second side of the seal assembly 51 opposite the first side. Each seal ring wall surface 54, 56 is cylindrical.

In this example, seal ring 53 is bi-directional, in that the seal is reinforced when pressure is applied in each of two directions. However, a seal ring 53 that is uni-directional may be used. The seal ring 53 has an upper section and a lower section that are substantially mirror images of each other. Each section has slots 57, 59. The inner and outer surfaces forming each slot 57, 59 comprise generally cylindrical surfaces that may be straight.

An upper energizing ring 31 engages slot 57 on the upper side, and a lower energizing ring 71 engages slot 59 on the lower side. Upper energizing ring 31 is forced downward into upper slot 57 by a running tool (not shown) connected to grooves 35 on upper energizing ring 31 during setting. Alternatively, seal assembly 51 and upper energizing ring 31 may be part of a string that is lowered into bore 21, the weight of which forces energizing ring 31 into upper slot 57. As the seal ring 53 moves downward, lower energizing ring 71 is forced into lower slot 59. Lock ring 81 on shoulder 17 prevents downward axial movement of lower energizing ring 71 during setting. Upper and lower energizing rings 31, 71 are formed of metal, such as steel.

Upper energizing ring 31 includes an upward facing retaining shoulder 39 on its outer surface that abuts against a downward facing retaining shoulder 63 located on the inner surface of the outer upper leg 61 of seal ring 53. Retaining shoulders 39, 63 ensure that seal ring 53 and upper energizing ring 31 are secured to each other. Lower energizing ring 71 includes a downward facing retaining shoulder 74 on its outer surface that abuts against an upward facing retaining shoulder 69 located on the inner surface of the outer lower leg 67 of seal ring 53. Retaining shoulders 74, 69 ensure that seal ring 53 and lower energizing ring 71 are secured to each other.

Inner surface 32 of upper energizing ring 31 contains a slight taper and upward facing shoulder 36 that form a pocket 37. A locking C-ring 41 with teeth 42 on its inner surface rides in pocket 37. A ring 45 rests between locking C-ring 41 and upper inner leg 60 of seal ring 53. When the seal assembly 51 is set, ring 45 forces C-ring 41 from pocket 37 on upper energizing ring 31 and teeth 42 mate with teeth 16 on casing hanger 15, locking the seal assembly 51 to casing hanger 15.

The end of lower energizing ring 71, opposite seal ring 53, is machined with tapered flanks 79. Lock ring 81 is machined with tapered flanks 82 on its inner surface that mate with tapered flanks 79 on lower energizing ring 71. The outer surface of the lower end of energizing ring 71 is machined with an upward facing shoulder 80. Lock ring 81 is machined with a downward facing shoulder 84 on its inner surface that mates with upward facing shoulder 80 on lower energizing ring 71. The outer surface of lock ring 81 contains grooves 83 that align with grooves 19 on wellhead member 11 when seal assembly 51 is set, locking casing hanger 15 to wellhead member 11.

Each of the energizing rings 31, 71 has a wedge member 33, 77 or engaging portion that engages one of the slots 57, 59. Each energizing ring 31, 71 has an inner surface 32, 75 and an outer surface 38, 73 for engaging the opposite inner sidewalls of each slot 57, 59. Inner and outer surfaces 32, 75, 38, 73 may be straight surfaces, as shown, or curved surfaces.

Figure 2:
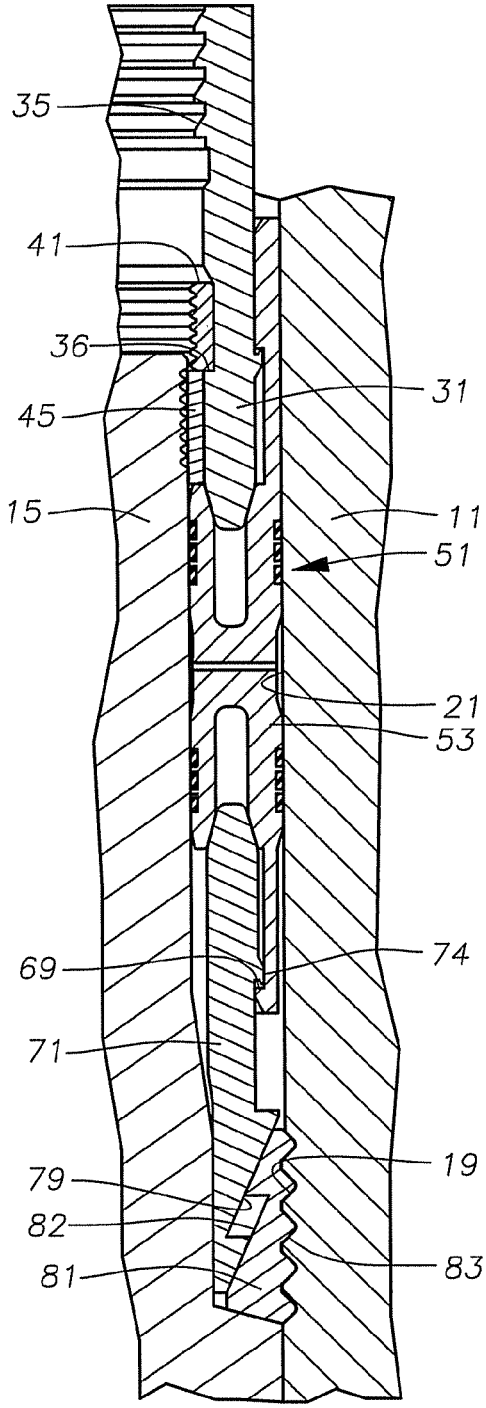
FIG. 2 is a sectional view of the seal assembly of FIG. 1 and shown in the landed position with the well pipe hanger lock mechanism energized.

In operation, a running tool or string is attached to seal assembly 51 (FIG. 1) and lowered into the well. For example, a running tool (not shown) can be attached to threads 35 on upper energizing ring 31. Seal assembly 51 is pre-assembled with upper energizing ring 31, C-ring 41, ring 45, seal ring 53, lower energizing 71, and lock ring 81 all connected to one another. As seal assembly 51 is lowered into bore 21, lock ring 81 will land on hanger shoulder 17. The weight of the running tool or the string causes lower energizing ring 71 to continue moving downward relative to lock ring 81. The tapered flanks 79 on the outer surface of energizing ring 71 slide against the mating tapered flanks 82 of lock ring 81. The downward movement of lower energizing ring 71 causes lock ring 81 to move radially outward. Grooves 83 on the outer surface of shoulder ring 81 align with grooves 19 on wellhead member 11, locking the casing hanger 15 to wellhead member 11 as shown in FIG. 2.

Figure 3:
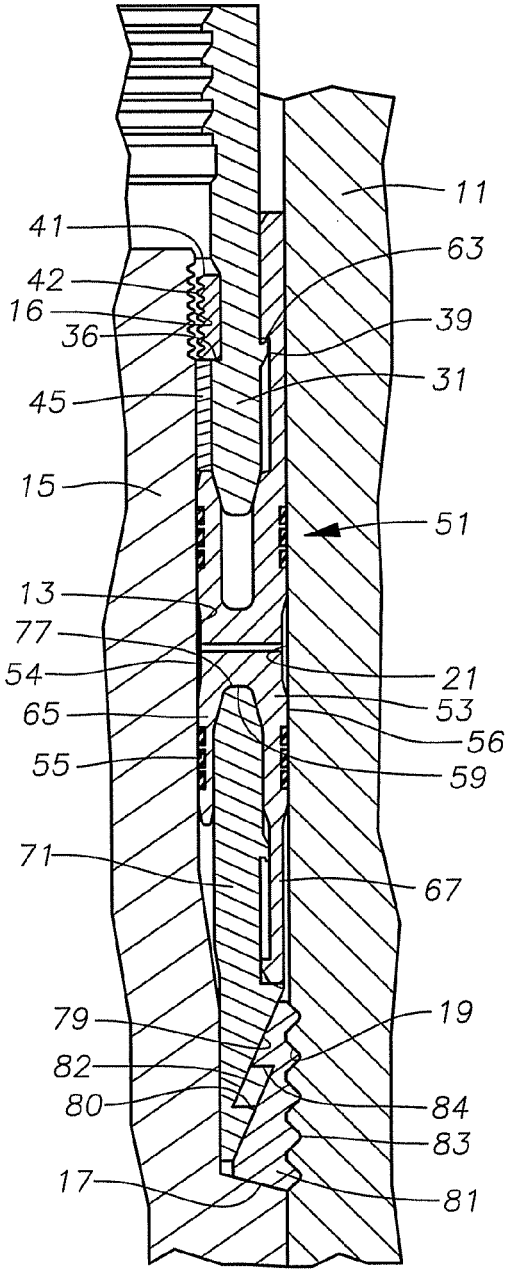
FIG. 3 is a sectional view of the seal assembly of FIG. 1 and shown in the landed position, with the lower seal section set.

The downward movement of running tool (not shown) and upper energizing ring 31 relative to lock ring 81 reduces the axial distance between lock ring 81 and upper energizing ring 31. The reduction causes lower energizing ring 71 to advance further into slot 59. This axial movement of lower energizing ring 71 forces lower outer seal wall 54 radially inward into sealing engagement with the cylindrical wall of seal pocket 13. This axial movement also forces lower outer wall 56 of seal ring 53 outward into sealing engagement with the wall of bore 21. As lower energizing ring 71 advances further into slot 59, the axial position of the seal assembly 51 and upper energizing ring 31 changes accordingly. As the entire seal assembly 51 moves axially, locking C-ring 41 and teeth 42, align with teeth 16 on the outer surface of hanger 15, as shown in FIG. 3. Vent passages or penetration holes may be incorporated across wedge 77 and through lower energizing ring 71 so that a hydraulic lock condition does not prevent axial make-up of the energizer and seal system. For test and monitoring purposes, a radial cross hole may be added across seal body 53.

Figure 4:
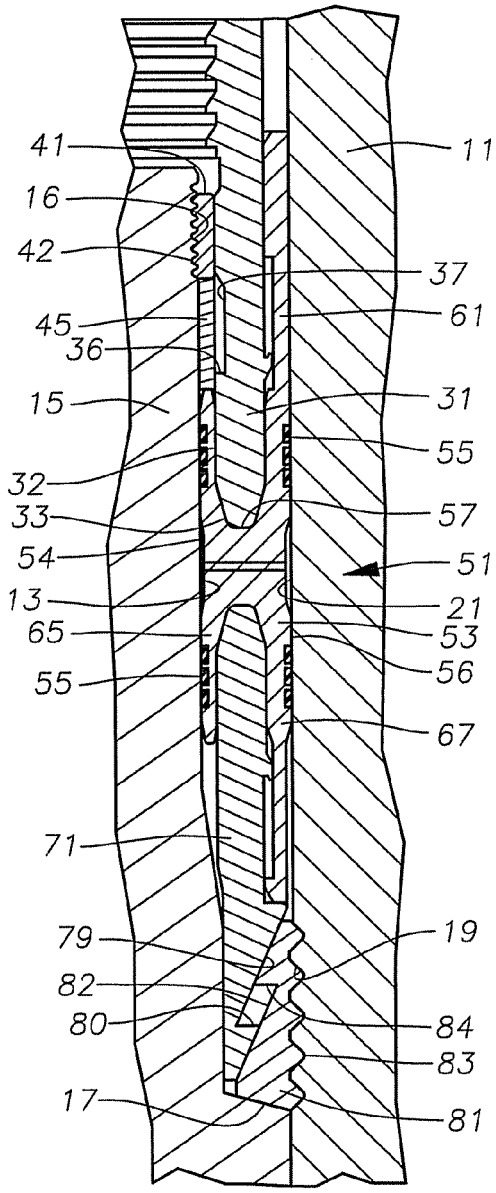
FIG. 4 is a sectional view of the seal assembly of FIG. 1 and shown in the landed position, with the lower seal section set and the upper seal section set and locked.

The continued downward movement of running tool (not shown) and upper energizing ring 31 relative to lock ring 81 further reduces the axial distance between C-ring 41 and upper energizing ring 31. The reduction causes upper energizing ring 31 to advance further into slot 57. This axial movement of upper energizing ring 31 forces upper seal wall 54 radially inward into sealing engagement with the cylindrical wall of seal pocket 13. This axial movement also forces upper wall 56 of seal ring 53 outward into sealing engagement with the wall of bore 21. The axial movement of C-ring 41 is restricted by ring 45, and as upper energizing ring 31 moves axially, ring 45 forces C-ring 41 from pocket 37 on inner surface 32 of upper energizing ring 31. Upper energizing ring 31 continues advancing into slot 57 and outer surface 32 forces C-ring 41 radially inward, placing teeth 42 into engagement with teeth 16 on hanger 15. As a result, C-ring 41 locks seal assembly 51 to hanger 15, as shown in FIG. 4. Vent passages or penetration holes may be incorporated across wedge 33 and through upper energizing ring 31 so that a hydraulic lock condition does not prevent axial make-up of the energizer and seal system.

Because of the locking interface between lock ring 81 and wellhead member 11, and the locking interface between C-ring 41 and casing hanger 15, an increase in axial length of seal pocket 13 due to thermal growth will not cause energizing rings 31, 71 to back out of slots 57, 59. The deflection of the upper and lower inner and outer walls 54, 56 of seal ring 53 is not beyond the elastic limit or yield strength of the metal of seal ring 53, and thus is not permanent.

As noted above, the seal ring 51 is reinforcing in each of two directions. The pressure below the seal ring 51 causes the lower portion of the seal ring to urge the overlays against the casing hanger 15 and wellhead 11. If there is an increase in pressure below the seal ring 51, the increase in pressure urges the arms of the downward-facing slot outward to produce a tighter seal. Similarly, the pressure above the seal ring causes the upper portion of the seal ring to urge the overlays against the casing hanger and wellhead. If there is an increase in pressure above the seal ring 51, the increase in pressure urges the arms of the upward-facing slot outward to produce a tighter seal.

In the event that seal assembly 51 is to be removed from bore 21, a running tool is connected to threads 35 on upper energizing ring 31. An upward axial force is applied to upper energizing ring 31, causing it to withdraw from slot 57, and C-ring 41 to disengage casing hanger 15 and return to pocket 37. However, due to retaining shoulders 63, 39, upper energizing ring 31 will remain engaged with seal ring 53, preventing the two from fully separating (FIG. 3). Lower energizing ring 71 withdraws from slot 59. However, due to retaining shoulders 69, 74 lower energizing ring 71 will remain engaged with seal ring 53, preventing the two from fully separating (FIG. 2). As lower energizing 71 moves upward, tapered flanks 79, 82 and shoulders 80, 84 act together to move lock ring 81 radially inward, thereby disengaging wellhead member 11. The upward facing shoulder 80 of lower energizing ring 71 and the downward facing shoulder 84 of lock ring 81 mate with one another and prevent the two from fully separating, ensuring that seal assembly 51 can be pulled from bore 21 and will remain fully intact (FIG. 1)

Figure 5:
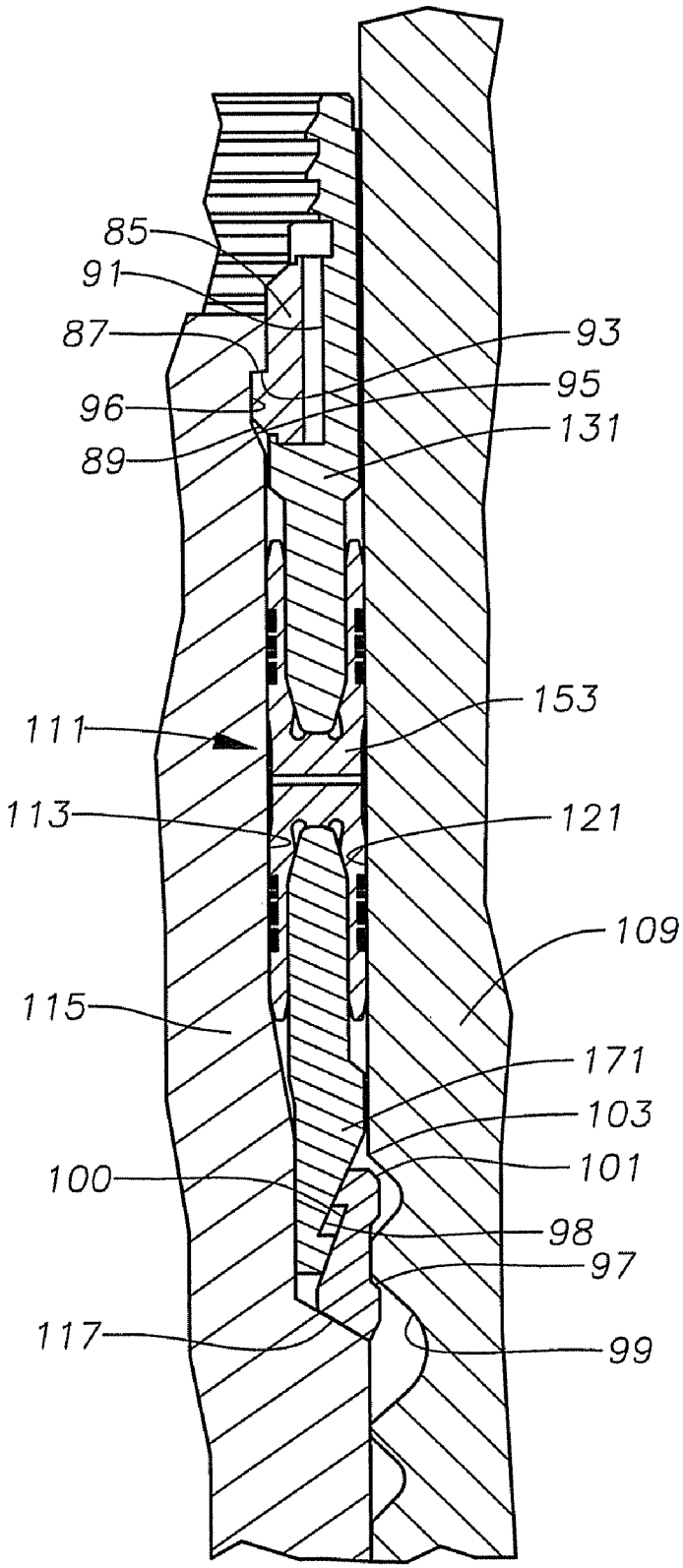
FIG. 5 is a sectional view of a seal assembly, in accordance with an alternative embodiment of the present techniques with an alternate seal ring locking mechanism.

Referring to FIG. 5, in an alternate embodiment of the present technique, a snap ring 85 locks seal assembly 111 to casing hanger 115. The inner surface of upper energizing ring 131 contains a pocket 91. An inwardly biased snap ring 85 rides in pocket 91. The inner surface of snap ring 85 forms a diagonal taper 89 on its lower end, with an upward facing shoulder 87 positioned just above taper 89. The outer surface of casing hanger 115 forms a taper 95 and downward facing shoulder 93 near the upper end of hanger 115 in seal pocket 113. Seal assembly 111 is pre-assembled with upper energizing ring 131, snap ring 85, seal ring 153, lower energizing 171, and lock ring 97 all connected to one another.

A plurality of debris traps 99 are formed on a lower inner portion of the wellhead housing 109 in bore 121. Debris traps 99 allow any debris located between hanger 115 and wellhead housing 109 to enter the traps when the seal assembly 111 is lowered, ensuring that shoulder 117 is fee of debris for proper landing and setting of the seal assembly 111.

As the seal assembly 111 is lowered into bore 121, lock ring 97 will land on hanger shoulder 117. The weight of the running tool or the string causes lower energizing ring 171 to continue moving downward relative to lock ring 97. The tapered flanks 98 on the outer surface of energizing ring 171 slide against the mating tapered flanks 100 of lock ring 97. The downward movement of lower energizing ring 171 causes lock ring 97 to move radially outward. The outer surface of lock ring 97 abuttingly contacts the inner surface of wellhead member 109, thereby locking the inner wellhead member 115 to the outer wellhead member 109. Although the lock ring 97 is in abutting contact with wellhead member 109, the seal assembly 111 and hanger 115 can move axially a defined increment. The space between the upper diagonal shoulder 101 of lock ring 97 and the geometrically opposed diagonal shoulder 103 on the inner surface of outer wellhead member 109 allows seal assembly 111 to move axially before the two contact one another, thereby prohibiting further upward axial movement.

When the seal assembly 111 lands, the taper 89 of snap ring 85 makes contact with the hanger 115, forcing snap ring 85 radially outward and into pocket 91 on upper energizing ring 131. The seal assembly 111 is set in the same fashion as previously illustrated for seal assembly 51. As the upper energizing ring 131 drives downward into seal ring 153, snap ring 85 springs radially inward toward recess 96 on the outer surface of the inner wellhead member 115. Upward facing shoulder 87 of snap ring 85 abuts against downward facing shoulder 93 of hanger 115, locking the seal assembly 111 to the casing hanger 115, and thereby locking inner wellhead member 115 and outer wellhead member 109 to one another. As previously illustrated, although the wellhead members 109, 115 are locked to one another small incremental axial movement of the inner wellhead member relative to the outer wellhead member is possible.

The techniques have significant advantages. In the first embodiment, the lock ring and the locking C-ring allow the entire seal assembly to be locked to the inner and outer wellhead members, limiting any axial movement of the seal assembly itself due to thermal expansion or increased exposure to pressures. In the second embodiment, the lock ring and the snap ring allow the entire seal assembly to be locked to the inner and outer wellhead members, however, the inner member may move axially a small increment relative to the outer member due to thermal expansion or increased exposure to pressures. In both embodiments, the shoulders on the seal ring and the energizing rings allow the seal assembly to be set, landed, and removed as one solid structure, reducing the risk of having to recover a single seal assembly component in the bore.

While the technique has been shown in only one of its forms, it should be apparent to those skilled in the art that it is not so limited but is susceptible to various changes without departing from the scope of the technique. For example, the seal could be configured for withstanding pressure in only a single direction, if desired, having only a single energizing ring. Each energizing ring could flexible, rather than solid.

The invention claimed is:

1. A wellhead seal assembly for sealing between inner and outer wellhead members, comprising:

a metal seal ring having upper inner and outer walls separated by a generally cylindrical upper slot and lower inner and outer walls separated by a generally cylindrical lower slot;

an upper metal energizing ring generally cylindrical in shape with surfaces that slidingly engage the inner and outer walls in the upper slot of the seal ring during installation to push the upper inner and outer walls into sealing engagement with the inner and out wellhead members;

a lower metal energizing ring generally cylindrical in shape with surfaces that slidingly engage the inner and outer walls in the lower slot of the seal ring during installation to push the lower inner and outer walls into sealing engagement with the inner and out wellhead members;

a resilient latch member carried by the upper metal energizing ring that is moved radially into latching engagement with the inner wellhead member in response to movement of the upper metal energizing ring; and a spacing member that enables the resilient latch member to engage the inner wellhead member prior to the upper metal energizing ring fully engaging the inner and outer walls in the upper slot of the seal ring.

2. The seal assembly according to claim 1, wherein the latch member comprises a radially expandable and contractible metal ring.

3. The seal assembly according to claim 1, wherein the latch member comprises a radially expandable and contractible metal ring having a set of teeth formed thereon.

4. The seal assembly according to claim 1, wherein the resilient latch member is a metal C-ring mounted to the upper energizing ring, the metal C-ring and having teeth on an inner surface for engaging the outer surface of the inner wellhead member during installation for locking the seal assembly to the inner wellhead member.

5. The seal assembly according to claim 1, wherein the latch member is mounted to the upper energizing ring.

6. The seal assembly according to claim 1, further comprising:

the latch member mounted in an annular recess on the inner diameter of the upper energizing ring; wherein the recess has a tapered surface so that downward movement of the upper energizing ring causes the tapered surface to push the latch member inward.

7. The seal assembly according to claim 1, further comprising:

a metal lock ring having a tapered inner surface, and an outer surface with grooves for engaging the inner surface of the outer wellhead member during installation for locking the inner wellhead member to the outer wellhead member.

8. The seal assembly according to claim 1, further comprising:

a first shoulder positioned on the outer surface of the upper energizing ring, and a second shoulder positioned on an inner surface of the upper outer wall of the metal seal ring, each shoulder facing one another and adapted to abuttingly contact one another, thereby limiting the withdraw of the upper energizing ring from the upper seal slot; and a first shoulder positioned on the outer surface of the lower energizing ring, and a second shoulder positioned on an inner surface of the lower outer wall of the metal seal ring, each shoulder facing one another and adapted to abuttingly contact one another, thereby limiting the withdraw of the lower energizing ring from the lower seal slot.

9. The wellhead assembly of claim 1, wherein the resilient latch member does not prevent upward movement of the upper metal energizing ring relative to the metal seal ring when the resilient latch member is in latching engagement with the inner wellhead member.

10. A wellhead assembly comprising:

an inner wellhead member;

an outer wellhead member;

a metal seal ring having inner and outer walls separated by a slot;

a metal energizing ring generally cylindrical in shape with surfaces that slidingly engage the inner and outer walls in the slot of the seal ring during installation to push the inner and outer walls into sealing engagement between the inner and outer wellhead members;

a resilient latch member carried by the metal energizing ring that is moved radially into latching engagement with the inner wellhead member in response to movement of the metal energizing ring; and a spacing member that enables the resilient latch member to engage the inner wellhead member prior to the metal energizing ring fully engaging the inner and outer walls in the slot of the seal ring.

11. The wellhead assembly of claim 10, further comprising:

a metal lock ring having a tapered inner surface, and an outer surface with grooves; wherein during installation of the seal, the shoulder ring moves radially outward, engaging the inner surface of the outer wellhead member and locking the inner wellhead member to the outer wellhead member.

12. The wellhead assembly of claim 10, wherein the resilient latch member further comprises a plurality of teeth on its inner surface.

13. The seal assembly according to claim 10, further comprising:

a first retainer shoulder positioned on the outer surface of the energizing ring, and a second retainer shoulder positioned on an inner surface of the outer wall of the seal ring, the first retainer shoulder and the second retainer shoulder facing one another and adapted to abuttingly contact one another, thereby limiting the withdrawal of the energizing ring from the seal slot.

14. The seal assembly according to claim 10 wherein the resilient member is carried in a recessed pocket on the inner surface of the energizing ring and a tapered surface is formed on an upper portion of the pocket.

15. The wellhead assembly of claim 10, wherein the resilient latch member does not prevent upward movement of the metal energizing ring relative to the metal seal ring when the resilient latch member is in latching engagement with the inner wellhead member.

16. A method for sealing an inner wellhead member to an outer wellhead member, comprising:

introducing a seal assembly with a seal ring with a cylindrical upper stets slot and a cylindrical lower slot and upper and lower energizing rings into a bore;

locking the seal assembly to the outer wellhead member by engaging the inner surface of the outer wellhead member with the seal assembly;

slidingly engaging the inner and outer walls of the lower slot with the lower energizing ring by forcing the lower energizing ring into the lower slot, thereby expanding the seal ring into contact with the inner wellhead member and outer member;

slidingly engaging the inner and outer walls of the upper slot with the upper energizing ring by forcing the upper energizing ring into the upper slot;

locking the seal assembly to the inner wellhead member by engaging the outer surface of the inner wellhead member with the seal assembly; and then further slidingly engaging the inner and outer walls of the upper slot with the upper energizing ring by forcing the upper energizing ring further into the upper slot, thereby fully expanding the seal ring into contact with the inner wellhead member and the outer wellhead member.

* * * * *